US007370395B2

(12) United States Patent
Tam

(10) Patent No.: US 7,370,395 B2
(45) Date of Patent: May 13, 2008

(54) HEATING APPARATUS AND PROCESS FOR DRAWING POLYOLEFIN FIBERS

(75) Inventor: Thomas Yiu-Tai Tam, Richmond, VA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/591,090

(22) Filed: Nov. 1, 2006

(65) Prior Publication Data

US 2007/0137064 A1 Jun. 21, 2007

Related U.S. Application Data

(60) Provisional application No. 60/751,895, filed on Dec. 20, 2005.

(51) Int. Cl.
*D02J 1/22* (2006.01)
*B29C 47/88* (2006.01)

(52) U.S. Cl. ..... 28/246; 264/211.17

(58) Field of Classification Search ..... 28/245, 28/246, 240, 219, 220, 172.2; 26/106, 99; 57/287; 34/60, 623, 209; 264/211.14, 211.15, 264/211.17, 211.18, 210.8, 290.5; 428/401, 428/364

See application file for complete search history.

(56) References Cited

U.S. PATENT DOCUMENTS 2,400,325 A * 5/1946 Winslow ..... 28/246
2,753,591 A * 7/1956 Stevens et al. ..... 26/97
2,955,342 A * 10/1960 Litzler et al. ..... 26/106
3,004,284 A * 10/1961 Limbach ..... 26/72
3,234,662 A * 2/1966 Alexeff et al. ..... 34/556
3,394,429 A * 7/1968 Nakagawa et al. ..... 28/246
3,528,763 A * 9/1970 Runton ..... 8/125
3,533,145 A * 10/1970 Fleissner ..... 19/0.46
3,643,844 A * 2/1972 Hunter ..... 226/111
3,672,013 A * 6/1972 Vernon et al. ..... 28/246
3,816,581 A * 6/1974 Prince, Jr. ..... 264/233
3,878,178 A * 4/1975 Guinn et al. ..... 526/240
4,413,110 A 11/1983 Kavesh et al. ..... 526/348.1
4,430,383 A 2/1984 Smith et al. ..... 428/364
4,436,689 A 3/1984 Smith et al. ..... 264/204
4,536,536 A 8/1985 Kavesh et al. ..... 524/462
4,545,950 A 10/1985 Mootoka et al. ..... 264/210.6
4,551,296 A 11/1985 Kavesh et al. ..... 264/203
4,612,148 A 9/1986 Mootoka et al. ..... 264/49
4,617,233 A 10/1986 Ohta et al. ..... 428/364
4,663,101 A 5/1987 Kavesh et al. ..... 264/178 F
5,032,338 A 7/1991 Weedon et al. ..... 264/203
5,246,657 A 9/1993 Yagi et al. ..... 264/210.6
5,286,435 A 2/1994 Slutsker et al. ..... 264/205

(Continued)

FOREIGN PATENT DOCUMENTS

GB 1473835 5/1977

*Primary Examiner*—A. Vanatta
(74) *Attorney, Agent, or Firm*—Bruce Bradford

(57) ABSTRACT

A heating apparatus and process useful for drawing ultrahigh molecular weight polyolefin fibers, such as polyethylene fibers. The heating apparatus includes a first set of rolls and a plurality of aligned ovens. The apparatus includes a second set of rolls at the exit of the ovens which rolls are adapted to provide the desired drawing of the polyolefin fibers. The apparatus and process provide a single draw step in a heated environment, with the use of preferably four or six horizontal ovens.

29 Claims, 1 Drawing Sheet

U.S. PATENT DOCUMENTS

| | | | | |
|---|---|---|---|---|
| 5,342,567 | A | 8/1994 | Chen et al. | 264/203 |
| 5,578,374 | A | 11/1996 | Dunbar et al. | 428/364 |
| 5,736,244 | A | 4/1998 | Kavesh et al. | 428/364 |
| 5,741,451 | A | 4/1998 | Dunbar et al. | 264/103 |
| 5,958,582 | A | 9/1999 | Dunbar et al. | 428/364 |
| 5,972,498 | A | 10/1999 | Kavesh et al. | 428/364 |
| 6,148,597 | A | 11/2000 | Cook | |
| 6,448,359 | B1 | 9/2002 | Kavesh | 526/352 |
| 6,969,553 | B1 | 11/2005 | Tam et al. | 428/364 |
| 2004/0040176 | A1 | 3/2004 | Mencke | 34/445 |
| 2005/0093200 | A1 | 5/2005 | Tam et al. | 264/211.14 |

* cited by examiner

HEATING APPARATUS AND PROCESS FOR DRAWING POLYOLEFIN FIBERS

CROSS-REFERENCE TO RELATED APPLICATIONS

This application claims the benefit of U.S. provisional application Ser. No. 60/751,895, filed Dec. 20, 2005.

BACKGROUND OF THE INVENTION

1. Field of the Invention

This invention relates to a heating apparatus for drawing polyolefin fibers and a process for drawing such fibers.

2. Description of the Related Art

High tenacity polyolefin fibers, such as gel-spun polyethylene fibers, are known in the art. Ultrahigh molecular weight polyolefins include polyethylene, polypropylene, poly(butene-1), poly(4-methyl-pentene-1), their copolymers, blends and adducts. They are prepared from ultrahigh molecular weight polyolefins, and in the case of polyethylene, ultrahigh molecular weight polyethylene (UHMWPE). The preparation and drawing of such fibers have been described in various patent publications, including U.S. Pat. Nos. 4,413,110; 4,430,383; 4,436,689; 4,536,536; 4,545,950; 4,551,296; 4,612,148; 4,617,233; 4,663,101; 5,032,338; 5,246,657; 5,286,435; 5,342,567; 5,578,374; 5,736,244; 5,741,451; 5,958,582; 5,972,498; 6,448,359; 6,969,553 and U.S. patent application publication 2005/0093200, the disclosures of which are expressly incorporated herein by reference to the extent not incompatible herewith. An oven for drawing fibers is also disclosed in U.S. patent application publication 2004/0040176.

UHMWPE yarns are useful in many applications, such as in impact absorption and ballistic resistant products. These include body armor, helmets, aircraft shields and composite sports equipment. They are also useful in fishing line, sails, ropes sutures and fabrics.

In a typical drawing configuration, the gel-spun fibers are prepared by spinning a solution of ultrahigh molecular weight polyethylene, cooling the solution filaments to a gel state and then removing the spinning solution. The spun fibers are then drawn to a highly oriented state. In the drawing operation, typically the spun fibers are first fed to a first stack of heated rolls, then through one or more ovens (typically four), then to a second stack of heated rolls, then to one or more additional ovens (typically two), and finally to a third stack of heated rolls before the fiber or yarn is wound up. The speed and temperature of the rolls are adjusted, as are the temperature and temperature profile in the ovens, to obtain the desired drawing ratio and product characteristics in the fiber or yarn. The fibers are subjected to a two stage draw operation in accordance with this configuration.

Although such a configuration has produced excellent quality fiber and yarn, the overall operation is expensive due to the multiple heating zones and sets of rolls, and the throughput is restricted. It would be desirable to provide an oven configuration for polyethylene fibers which was less expensive to operate and could provide drawn fibers or yarns at a higher rate.

SUMMARY OF THE INVENTION

In accordance with this invention, there is provided a heating apparatus useful for drawing ultrahigh molecular weight polyolefin fibers, the heating apparatus comprising:

a first set of rolls;

a plurality of aligned ovens, the plurality of ovens having one end adjacent to the first set of rolls and an opposite end; and a second set of rolls adjacent to the opposite end of the plurality of ovens, the first and second set of rolls being adapted to provide the desired drawing of the polyolefin fibers.

Also in accordance with this invention, there is provide a process for drawing ultrahigh molecular weight polyolefin fibers, the process comprising passing the fibers through a heating apparatus, the heating apparatus comprising:

a plurality of aligned ovens, the plurality of ovens having one end adjacent to the first set of rolls and an opposite end; and a second set of rolls adjacent to the opposite end of the plurality of ovens, the first and second set of rolls being operated under conditions to provide the desired drawing of the polyolefin fibers and drawing the fibers between the first set of rolls and the second set of rolls to a predetermined draw ratio.

It has been found that by modifying the previous drawing configuration by eliminating the second set of rolls and providing a series of horizontal ovens, polyolefin fibers such as polyethylene fibers having desirable properties can be obtained at lower capital expense, lower operating expense and at greater throughput. Such fibers also have improved properties.

BRIEF DESCRIPTION OF THE DRAWINGS

This invention will become more fully understood and further advantages will become apparent when reference is made to the following detailed description of the preferred embodiments of the invention and the accompanying drawings, in which.

DETAILED DESCRIPTION OF THE INVENTION

Figure 1:
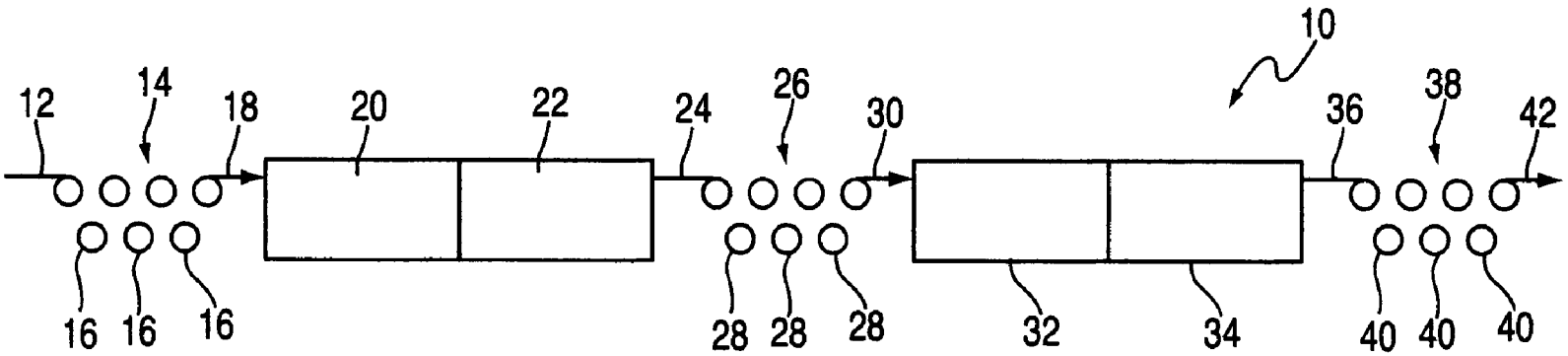
FIG. 1 is a schematic view of a typical oven configuration employed in the drawing of polyethylene fibers.

The present invention comprises a heating apparatus for drawing ultrahigh molecular weight polyolefin fibers and a process for drawing such fibers.

For the purposes of the present invention, a fiber is an elongate body the length dimension of which is much greater that the transverse dimensions of width and thickness. Accordingly, the term "fiber" includes one, or a plurality of, monofilament, multifilament, ribbon, strip, staple and other forms of chopped, cut or discontinuous fiber and the like having regular or irregular cross-sections. The term "fiber" includes a plurality of any of the foregoing or a combination thereof. A yarn is a continuous strand comprised of many fibers or filaments.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably substantially circular.

Ultrahigh molecular weight polyolefins useful in the present invention include polyethylene, polypropylene, poly (butene-1), poly(4-methyl-pentene-1), their copolymers, blends and adducts. These polymers typically have an intrinsic viscosity when measured in decalin at 135° C. of from about 5 to about 45 dl/g.

Preferably, the feed yarn to be drawn comprises a polyethylene having an intrinsic viscosity in decalin of from about 8 to 40 dl/g, more preferably from about 10 to 30 dl/g, and most preferably from about 12 to 30 dl/g. Preferably, the yarn to be drawn comprises a polyethylene having fewer than about one methyl group per thousand carbon atoms, more preferably fewer than 0.5 methyl groups per thousand carbon atoms, and less than about 1 wt. % of other constituents. The ultrahigh molecular weight polyolefins may contain small amounts, generally less than about 5 weight percent, and preferably less than about 3 weight percent, of additives such as anti-oxidants, thermal stabilizers, colorants, flow promoters, solvents, and the like.

The gel-spun polyethylene fibers to be drawn in the process of the invention may have been previously drawn, or they may be in an essentially undrawn state. The process for forming the gel-spun polyethylene feed yarn can be one of the processes described, for example, by any of U.S. Pat. Nos. 4,551,296, 4,663,101, 5,741,451, and 6,448,659.

In the case of polyethylene suitable fibers are those of weight average molecular weight of at least about 150,000, preferably at least about one million and more preferably between about two million and about five million. In the case of high molecular weight polypropylene fibers, these may have a weight average molecular weight at least about 200,000, preferably at least about one million and more preferably at least about two million.

The tenacity of the feed yarn may range from about 2 to 76, preferably from about 5 to 66, more preferably from about 7 to 51, grams per denier (g/d) as measured by ASTM D2256-97 at a gauge length of 10 inches (25.4 cm) and at a strain rate of 100%/min.

In the following description reference is typically made to polyethylene fibers but it should be understood that such disclosure also applies to other polyolefin fibers.

With reference to FIG. 1, there is shown in schematic view a typical drawing operation 10 for ultrahigh molecular weight polyethylene yarn. Yarn 12 is fed from a source (not shown) and is passed over a first set 14 of rolls 16. These rolls are typically heated to a desired temperature. The yarn 18 exiting the rolls is fed into four adjacent horizontal ovens, only two of which 20, 22 are shown. These ovens may be hot air circulating ovens. The yarn 24 exiting the first set of ovens then passes over a second set 26 of rolls 28 and is drawn as yarn 30. Yarn 30 is then fed into two more adjacent ovens 32, 34, which may also be hot air circulating ovens, and the yarn 36 exiting oven 34 is then fed over a third set 38 of rolls 40 and is again drawn to the desired amount. The finished yarn 42 is then fed to a wind up station (not shown). By employing three sets of rolls, the fibers are subjected to a two stage drawing operation.

Figure 2:
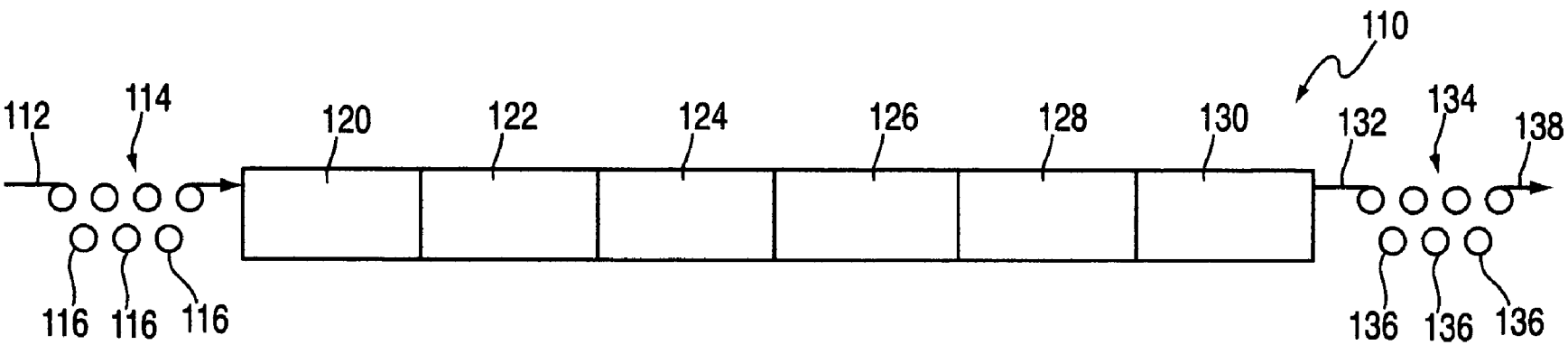
FIG. 2 is a schematic view of the oven configuration of this invention which is useful in the drawing of ultrahigh molecular weight polyethylene fibers.

With reference to FIG. 2, there is shown in schematic view the heating apparatus 110 of this invention. Ultrahigh molecular weight polyethylene yarn 112 is fed from a source (not shown) and is passed over a first set 114 of driven rolls 116. These rolls need not be heated, although preferably the first few rolls are not heated and the remaining rolls are heated to preheat the fibers prior to drawing. Although a total of 7 rolls is shown in FIG. 2, the number of rolls may be higher or lower, depending upon the desired configuration. The yarn 118 is fed into six adjacent horizontal ovens 120, 122, 124, 126, 128, 130, all of which preferably are hot air circulating ovens. The yarn is preferably not supported in the ovens. Yarn 132 exiting last oven 130 then passes over a second set 134 of driven rolls 136, and is drawn into finished yarn 138. The second set 134 of rolls 136 should be cold so that the finished yarn is cooled to at least below about 90° C. under tension to preserve its orientation and morphology. The number of rolls in second set 134 may be higher or lower than that the 7 rolls shown in FIG. 2, and may be the same or different from the number of rolls in first roll set 114. Yarn 138 exiting second roll set 134 is then fed to a wind up station (not shown). By employing only two sets of rolls, the fibers are subjected to a single stage drawing operation. The fibers are drawn between first roll set 114 and second roll set 134. The tension is adjusted so that the fibers need not be supported in the ovens. Thus, there is no need for idler rolls or other supporting devices in the various ovens.

It can be seen that in the embodiment of this invention as shown in FIG. 2 is a simpler design in which only two sets of rolls are needed. The middle set of rolls of the typical apparatus has been eliminated and replaced by two additional hot air ovens. In addition, not all of the inlet set of rolls need to be heated, and only the rolls closest to the oven entrance may be heated. For example, in one embodiment with a nine set roll configuration only the last three rolls closest to the oven entrance are preferably heated.

In an alternate embodiment, the center ovens (124, 126) are not included in the heating apparatus, but the middle set of rolls of the typical configuration is eliminated and only a total of four horizontal ovens (120, 122, 128, 130) are employed.

The number and size of the ovens employed in the heating apparatus of this invention may vary. Preferably there are either four or six ovens aligned in a horizontal manner. These ovens may vary in length. For example, each oven may be from about 10 to about 16 feet (3.05 to 4.88 meters) long, more preferably from about 11 to about 13 feet (3.35 to 3.96 meters) long. Their width may be any suitable width.

It has been found by thermal imaging measurements and yarn speed measurements that in the typical drawing process the yarn that is heated by the first set of rolls has already cooled down before it reaches the first set of ovens (ovens 20, 22). As a result, part of the first oven set is used to heat the yarn rather than draw the yarn. While the second set of rolls 26 does heat up the yarn again, the yarn has already begun to cool before it reaches the second set of ovens (ovens 32, 34). Similarly, part of the second oven set is used to heat the yarn rather than draw the yarn. This process in which the yarn is subject to heat, cool, heat, cool steps has been found to be not as efficient as desired to achieve the high draw ratio needed to obtain high ultimate tensile strength (UTS), high tenacity and high modulus. In addition, the operation yield is reduced and the capital cost is increased due to the need for three sets of rolls.

It has been found that by eliminating the middle set of rolls the yarn is not subject to the heat, cool, heat, cool process steps of the typical process. Rather, the yarn maintains the heat needed for continuous drawing of the yarn. Thus, yarn can be produced at higher speeds and the yarn can have improved tenacity, modulus and ultimate tensile strength. The straight-line oven arrangement also increases operation efficiency.

It can be seen that the heating apparatus permits a continuous, single stage drawing of the fiber or yarn under heat with only the use of two sets of rolls. In addition, the apparatus and process of the invention can be operated to draw the fiber away from the maximum draw ratio in order to reduce the potential for broken filaments.

The temperature and speed of the yarn through the heating apparatus may be varied as desired. For example, one or more temperature controlled zones may exist in the ovens, with each zone having a temperature of from about 125° C. to about 160° C., more preferably from about 130° C. to about 150° C. Preferably the temperature within a zone is controlled to vary less than ±2° C. (a total less than 4° C.), more preferably less than ±1° C. (a total less than 2° C.).

The drawing of yarn generates heat. It is desired to have effective heat transmission between the yarn and the oven air. Preferably, the air circulation within the oven is in a turbulent state. The time-averaged air velocity in the vicinity of the yarn is preferably from about 1 to about 200 meters/min, more preferably from about 2 to about 100 meters/min, and most preferably from about 5 to about 100 meters/min.

As pointed out above, the yarn path in heating apparatus 110 is preferably in an approximate straight line from inlet to outlet of the various ovens. The yarn tension profile may be adjusted by adjusting the speed of the various rolls or by adjusting the oven temperature profile. Yarn tension may be increased by increasing the difference between the speeds of consecutive driven rolls or decreasing the temperature in the ovens. Preferably, the yarn tension in the ovens is approximately constant, or is increasing through the ovens.

Typically, multiple packages of gel-spun polyethylene yarns to be drawn are placed on a creel. Multiple yarns ends are fed in parallel from the creel through the first set of rolls that set the feed speed into the drawing oven, and thence through the ovens and out to the second set of rolls that set the yarn exit speed and also cool the yarn under tension. The tension in the yarn during cooling is maintained sufficient to hold the yarn at its drawn length neglecting thermal contraction.

The overall draw ratio of the fibers may vary, depending on the desired properties of the fibers. For example, the draw ratio may range from about 1.1:1 to about 15:1, more preferably from about 1.2:1 to about 10:1, and most preferably from about 1.5:1 to about 10:1.

The speed of the fibers through the heating apparatus of this invention may also vary. For example, typical lines speeds as measured by the speed of the second set of rolls may be from about 20 to 100 meters/min., more preferably from about 30 to about 50 meters/min. The line speed is also dependent on the desired denier of the yarn.

The apparatus and process of this invention are useful to produce high tenacity fibers. As used herein, the term "high tenacity fibers" means fibers which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn.

Depending upon the formation technique, the draw ratio and temperatures, and other conditions, a variety of properties can be imparted to these fibers. The tenacity of the polyethylene fibers are at least about 7 g/d, preferably at least about 15 g/d, more preferably at least about 20 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. In a most preferred embodiment, the fibers after drawing have a tenacity of at least about 35 g/d and a modulus of at least about 1,200 g/d. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

The resultant yarns may have any suitable denier, such as from about 50 to about 3000 denier, more preferably from about 75 to about 2000 denier. Examples of fine denier products include those of 75, 100, 130, 150, 180, 215, 375 and 435 denier. Examples of high denier products include 900, 1100 and 1300 denier. The feed yarn denier is chosen depending on the desired denier of the yarn. For example, to produce a 1300 denier yarn the feed yarn may be 2400 denier, and thus the draw ratio is about 1.85:1. To produce a 375 denier product, the feed yarn may be 650, with a draw ratio of about 1.73.

The yarns produced by the apparatus and process of this invention may be used in a variety of applications for which such yarns are suitable. They are useful in impact absorption and ballistic resistant products, such as body armor (bullet resistant vests and the like), helmets, aircraft shields and seats, composite sports equipment, and in fishing line, sails, ropes, sutures and fabrics (e.g., woven, knitted, braided or non-woven). Typical non-woven fabrics include a unidirectionally array of oriented yarns. Fabrics formed from such yarns may be used together with a matrix resin. They yarns may be blended with other types of yarns, both high strength and conventional strength yarns.

The following non-limiting examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1 (Comparative)

Ultrahigh molecular weight polyethylene fibers are drawn in a two stage draw in an oven configuration which includes a first set of four ovens and a second set of two ovens, with a first set of rolls, an intermediate second set of rolls and a third set of rolls in a manner as depicted in FIG. 1.

The length of each oven is 12 feet (3.66 m) so the first set of 4 ovens totals 48 feet (14.63 m) and the second set of ovens totals 24 feet (7.32 m).

The temperature of the rolls is as follows: first set=125° C., second set=125° C. and the third set=25° C. The temperatures of the first and second sets of ovens are 150° C.

The starting denier is 2400 and the final denier is 1100. The draw ratio is 2:2:1. The speed of the first set of rolls is 16 m/min, the speed of the second set is 26 m/min and the speed of the third set of rolls is 34 m/min.

The tenacity of the resulting fiber is from 35 to 37 g/d and the initial tensile modulus is 1150 to 1200 g/d.

Example 2

In this example, ultrahigh molecular weight polyethylene fibers are drawn in a single stage draw in an oven configuration which includes a set of six horizontally aligned ovens, in a manner as depicted in FIG. 2. Only two sets of rolls are used, an inlet set (first set) and an exit set (second set).

The length of each oven is 12 feet (3.66 meters), so the total length of the 6 ovens is 72 feet (21.95 meters).

The first set of rolls has a temperature of 125° C., and the second set of rolls has a temperature of 25° C. The temperature of each oven is 150° C.

The starting denier is 2400 denier and the final denier is 1100 denier with a draw ratio 2:1:1. The speed for the first set of rolls is 20 m/min and the speed of the second set of rolls is 44 m/min.

The tenacity of the resulting fiber is from 37 to 39 g/d and the initial tensile modulus is 1250 to 1300 g/d.

It can be seen that the heating apparatus employed in Example 2 and operated in a manner of Example 2 provides fibers of higher tenacity and modulus than the fibers of the oven configuration of Example 1. Also, the line speed of Example 2 is significantly higher than in Example 1 so that there is an increase in the productivity of the process.

It can be seen that the present invention provides an apparatus and method for forming drawn ultrahigh molecular weight polyolefin fibers and yarns, such as polyethylene fibers and yarns, in a cost-effective and operationally friendly manner. The resultant yarns have the desirable properties to be useful in a variety of demanding applications.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A heating apparatus for drawing ultrahigh molecular weight polyolefin fibers in a one stage draw with continuous heating, said heating apparatus consisting essentially of:

a first set of rolls;

a plurality of horizontally aligned ovens, said plurality of ovens having one end adjacent to said first set of rolls and an opposite end, said ovens being arranged such that their respective ends are in abutting relationship to thereby provide a relatively long continuous oven such that said fibers are conveyed from said one end of said continuous oven to said opposite end of said continuous oven, and a second set of rolls adjacent to said opposite end of said plurality of ovens, said first and second set of rolls being adapted to provide the desired drawing of said polyolefin fibers and to convey said fibers through said continuous oven.

2. The heating apparatus of claim 1 wherein said fibers comprise ultrahigh molecular weight polyethylene fibers.

3. The heating apparatus of claim 1 wherein only a portion of said first set of rolls are heated.

4. The heating apparatus of claim 1 wherein said ovens are hot air circulating ovens.

5. The heating apparatus of claim 1 comprising at least four horizontally aligned ovens.

6. The heating apparatus of claim 1 comprising at least six horizontally aligned ovens.

7. The heating apparatus of claim 2 wherein each of said first set and said second set of rolls comprises 7 rolls.

8. The heating apparatus of claim 2 wherein each of said first set and said second set of rolls comprises 9 rolls.

9. The heating apparatus of claim 1 including means for transporting said fibers through said ovens in an approximate straight line.

10. The heating apparatus of claim 1 wherein said first and second sets of rolls comprise the only rolls in said heating apparatus and said fibers are unsupported between said first set of rolls and said second set of rolls.

11. A process for drawing ultrahigh molecular weight polyolefin fibers, said process comprising passing said fibers through a heating apparatus, said heating apparatus consisting essentially of:

a first set of rolls;

a plurality of horizontally aligned ovens, said ovens being arranged such that their respective ends are in abutting relationship to thereby provide a relatively long continuous oven, said plurality of ovens having one end adjacent to said first set of rolls and an opposite end; and a second set of rolls adjacent to said opposite end of said plurality of ovens, said first and second set of rolls being operated under conditions to provide the desired drawing of said polyolefin fibers, and drawing said fibers between said first set of rolls and said second set of rolls to a predetermined draw ratio in a one stage draw with continuous heating of said fibers, with said fibers being conveyed from said one end of said continuous oven to said opposite end of said continuous oven and through said continuous oven.

12. The process of claim 11 wherein said fibers comprise polyethylene fibers.

13. The process of claim 11 wherein only a portion of said first set of rolls are heated.

14. The process of claim 11 wherein said ovens are hot air circulating ovens.

15. The process of claim 11 wherein said apparatus comprises at least four horizontally aligned ovens.

16. The process of claim 11 wherein said apparatus comprises at least six horizontally aligned ovens.

17. The process of claim 12 wherein each of said first set and said second set of rolls comprises 7 rolls.

18. The process of claim 12 wherein each of said first set and said second set of rolls comprises 9 rolls.

19. The process of claim 11 wherein said fibers are transported through said ovens in an approximate straight line.

20. The process of claim 11 wherein said fibers are not supported by any structure in said ovens.

21. The process of claim 11 wherein said fibers are drawn to a draw ratio of from about 1.1:1 to about 15:1.

22. The process of claim 11 wherein said fibers are drawn to a draw ratio of from about 1.2:1 to about 10:1.

23. The process of claim 11 wherein said process operates at a line speed of from about 20 to about 100 meters/min.

24. The process of claim 11 wherein the temperature in said ovens is from about 125° C. to about 160° C.

25. The process of claim 11 wherein the temperature in said ovens is from about 130° C. to about 150° C.

26. The process of claim 11 wherein said first and second sets of rolls comprise the only rolls in said heating apparatus and wherein said fibers are unsupported between said first set of rolls and said second set of rolls.

27. The process of claim 11 wherein the fibers resulting from said process have a tenacity of at least about 30 grams per denier.

28. The process of claim 12 wherein the fibers resulting from said process have a tenacity of at least about 35 grams per denier and a initial tensile modulus of at least about 1,200 g/d.

29. A product formed by the process of claim 11.

* * * * *